US005165689A

United States Patent [19]

Forsse et al.

[11] Patent Number: 5,165,689

[45] Date of Patent: Nov. 24, 1992

[54] THREE-DIMENSIONAL JIGSAW PUZZLE SCULPTURE

[76] Inventors: Earl K. Forsse; Janis R. Forsse, both of 210 Cliff Dr., Laguna Beach, Calif. 92651

[21] Appl. No.: 650,887

[22] Filed: Feb. 5, 1991

[51] Int. Cl.[5] ..... A63F 9/12

[52] U.S. Cl. ..... 273/157 R; 446/105; 446/118

[58] Field of Search ..... 273/153 R, 156, 157 R; 40/152; 446/97, 101, 105, 108, 118; 428/33

[56] References Cited

U.S. PATENT DOCUMENTS

| | | | |
|---|---|---|---|
| D. 264,858 | 6/1982 | Dennis | D21/107 |
| D. 273,964 | 5/1984 | Roth | D21/104 |
| 1,964,007 | 6/1934 | Parks | 273/157 |
| 2,493,697 | 1/1950 | Raczkowski | 35/28 |
| 2,507,354 | 5/1950 | Spunberg | 446/105 |
| 2,957,251 | 10/1960 | Nystad et al. | 35/46 |
| 2,987,318 | 6/1961 | Hammer | 273/157 R |
| 3,171,540 | 3/1965 | Douglas | 273/157 R |
| 3,692,312 | 9/1972 | Meyer | 273/157 R |
| 3,981,506 | 9/1976 | Daniel et al. | 273/157 R |
| 4,332,387 | 6/1982 | Mullen, III | 273/156 |
| 4,385,467 | 5/1983 | Samuels | 46/16 |
| 4,874,176 | 10/1989 | Auerbach | 273/157 R |

*Primary Examiner*—Paul E. Shapiro
*Assistant Examiner*—William M. Pierce
*Attorney, Agent, or Firm*—Kelly, Bauersfeld & Lowry

[57] ABSTRACT

A three-dimensional jigsaw puzzle sculpture is provided for use in retaining puzzle pieces in assembled form in a decorative piece of art. The jigsaw puzzle sculpture includes a frame which defines the shape of the sculpture, and puzzle assembled to the frame. The frame has a three-dimensional configuration and includes a channel extending around the periphery of each frame section to hold the puzzle pieces in place. Each frame section provides a substantially planar surface circumscribed by a channel, which planar surface provides a support for the puzzle pieces. The planar surfaces include one or more apertures which are utilized to remove the puzzle pieces from the frame. Separable frame members are assembled to one another utilizing pin and hole interlocks. The three-dimensional jigsaw puzzle sculpture, when fully assembled, provides a decorative piece of art which may be subsequently disassembled and reassembled as desired.

12 Claims, 2 Drawing Sheets

FIG. 3
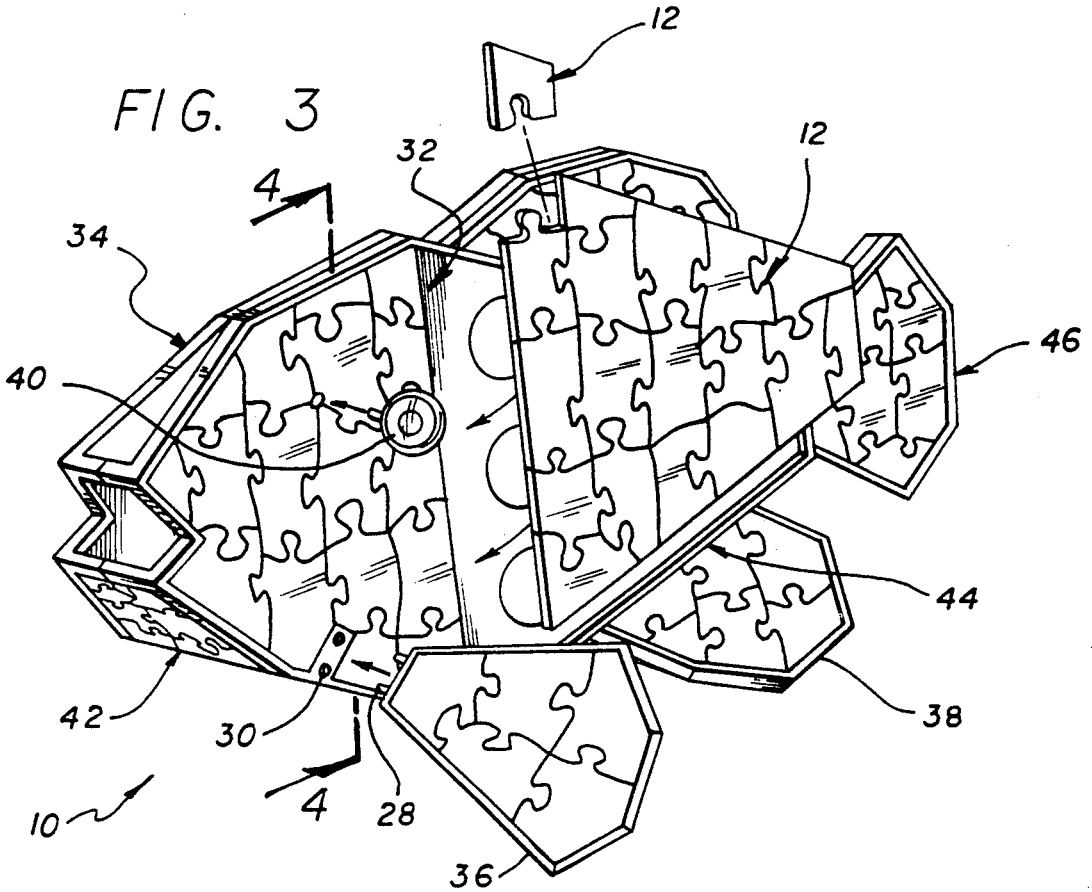
FIG. 4
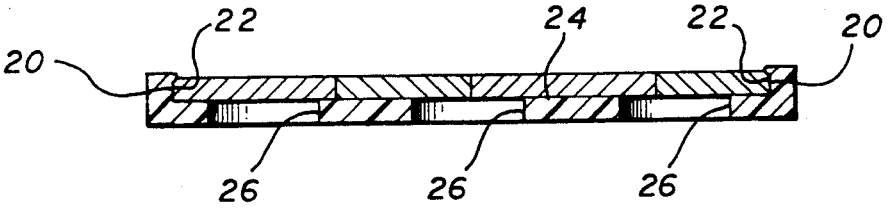
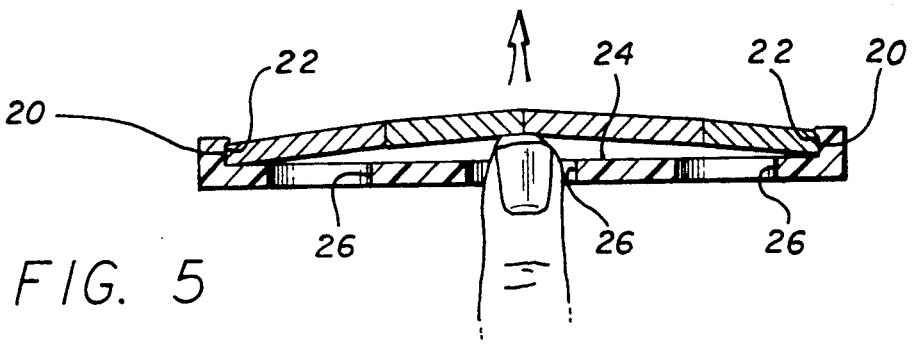
FIG. 5

THREE-DIMENSIONAL JIGSAW PUZZLE SCULPTURE

FIELD OF THE INVENTION

This invention relates generally to an art piece in the form of a puzzle. More specifically, this invention relates to a decorative three-dimensional jigsaw puzzle sculpture that retains the jigsaw puzzle pieces in assembled form.

BACKGROUND OF THE INVENTION

Toy manufacturers have long recognized the consumer interest in toys that are both entertaining and stimulating. Puzzles may be considered representative of such toys, providing a challenge to their assemblers. In many instances, the more complex the puzzle, the more rewarding its assembly.

One type of puzzle, the jigsaw puzzle, is made by cutting up a picture or design into pieces of irregular shape, which must be put together again to reform the picture or design. The picture or design made by the assembled pieces would often make for an attractive decoration but the pieces will not independently stay assembled. Moreover, it is often a lengthy process to assemble the jigsaw puzzle, especially when the puzzle is complex because of the number of pieces or the picture/design itself. However, the puzzle must often be disassembled soon after assembly to avoid taking up table-top space.

In recognition of these problems, assemblers of puzzles have glued the pieces onto backings thereby keeping the pieces assembled. While an attractive wall decoration may be created in this manner, the practice precludes the possibility of future disassembly and subsequent reassembly of the puzzle. Moreover, it is evident that traditional jigsaw puzzles can only provide a two dimensional decoration if the pieces are glued to a backing as described.

Accordingly, there has been a need for a three-dimensional jigsaw puzzle sculpture which is capable of holding the pieces in assembled form, is of simplified construction, and which retains the entertaining characteristics common to traditional jigsaw puzzles. Such a sculpture is needed which provides an entertaining, challenging and educational experience for the assembler, and which will also result in an aesthetically pleasing art piece in the form of a showcase for the puzzle. There is a further need for such a three-dimensional jigsaw puzzle sculpture which may be modified by the assembler by changing the shape, design and/or color of the puzzle pieces. The present invention fulfills these needs and provides other related advantages.

SUMMARY OF THE INVENTION

The present invention resides in a three-dimensional jigsaw puzzle sculpture which keeps the puzzle pieces assembled in the form of a picture or design, provides an entertaining and educational experience for the assembler of the puzzle, and will result in a changeable, aesthetically pleasing, art piece. The sculpture comprises, generally, a plurality of jigsaw puzzle pieces removably held within a three-dimensional frame which provides the shape of the sculpture. Retaining means are incorporated into the frame for holding the jigsaw puzzle pieces in place without use of an adhesive.

In a preferred form of the invention, the jigsaw puzzle pieces provide surface design and color to the sculpture. The individual puzzle pieces generally have side surfaces configured to interlock with abutting side surfaces of adjacent pieces in a conventional manner. The assembled puzzle pieces typically form a picture or present a pleasing design. The outermost puzzle pieces in each section of the sculpture have at least one smooth (curvilinear or flat) side surface which is captured by the retaining means.

The frame defines the shape of the sculpture. For example, in the illustrated embodiment, the frame defines the shape of a fish. The frame includes smooth-sided (curvilinear or flat) primary and secondary frame members which are interlocked by means of corresponding pins and holes to one another during assembly. The primary frame members, which may be congruent halves, form the main frame body. The secondary frame members may be added to the primary frame members to provide additional detail to the sculpture. The frame members collectively define a plurality of outer substantially planar surfaces for receiving the assembled jigsaw puzzle pieces.

The frame retaining means hold the assembled puzzle pieces adjacent to the frame planar surfaces. The retaining means comprise channels which extend around the periphery of each frame member. The channels are positioned to extend outwardly from the adjacent frame planar surface, and are configured to frictionally capture the smooth side surfaces of the outermost puzzle pieces. A plurality of substantially circular apertures in the planar surfaces allow the puzzle pieces to be easily pushed out and removed from the frame when disassembly is desired.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a perspective view similar to FIGS. 1 and 2, illustrating the assembly a secondary frame member (a fin) and an eye to the main frame body, and also the placement of a plurality of assembled puzzle pieces in the left rear body portion of the fish sculpture;

FIG. 4 is an enlarged sectional view taken generally along the line 4—4 of FIG. 1, illustrating the manner in which the frame retains the puzzle pieces adjacent to the outer planar surfaces of the frame; and FIG. 5 is a sectional view similar to that shown in FIG. 4, illustrating the manner in which the puzzle pieces may be pushed through an aperture in the frame planar surface for removal from the frame.

DETAILED DESCRIPTION OF THE PREFERRED EMBODIMENT

Figure 1:
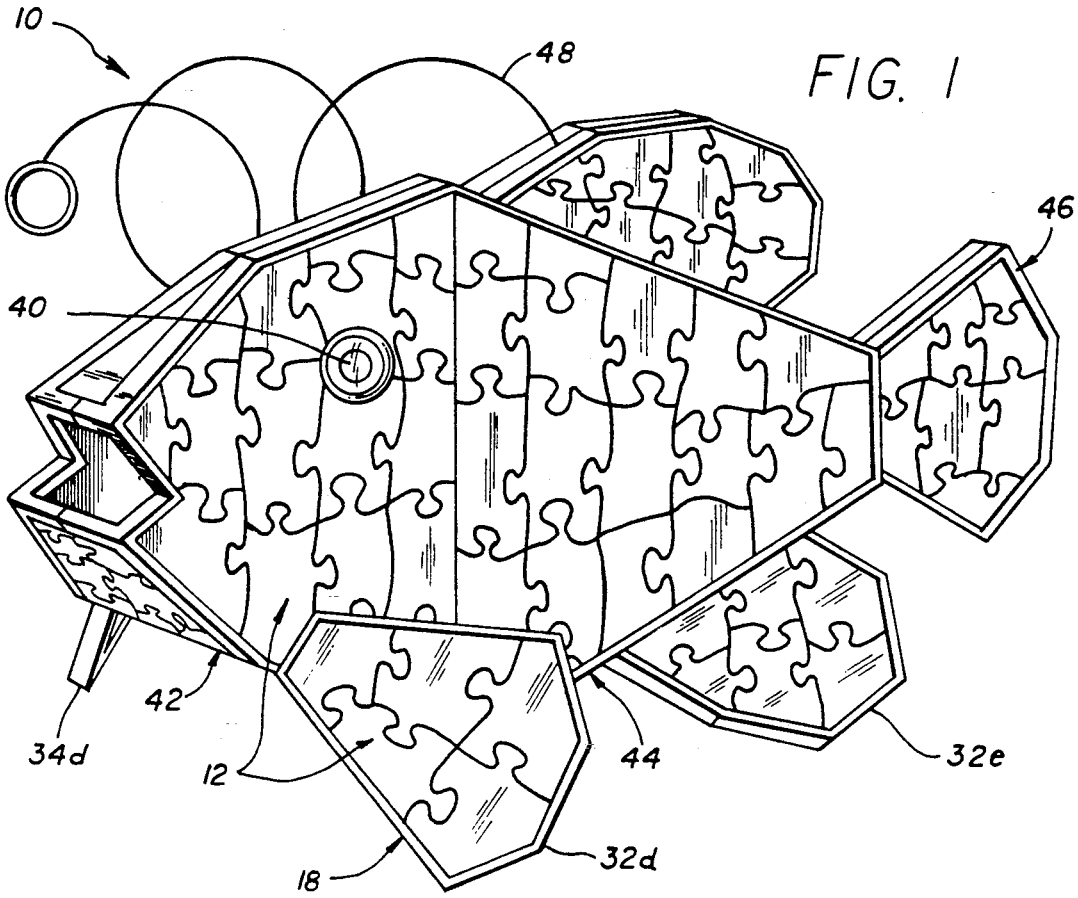
FIG. 1 is a perspective view of an exemplary three-dimensional jigsaw puzzle sculpture embodying the invention.
Figure 2:
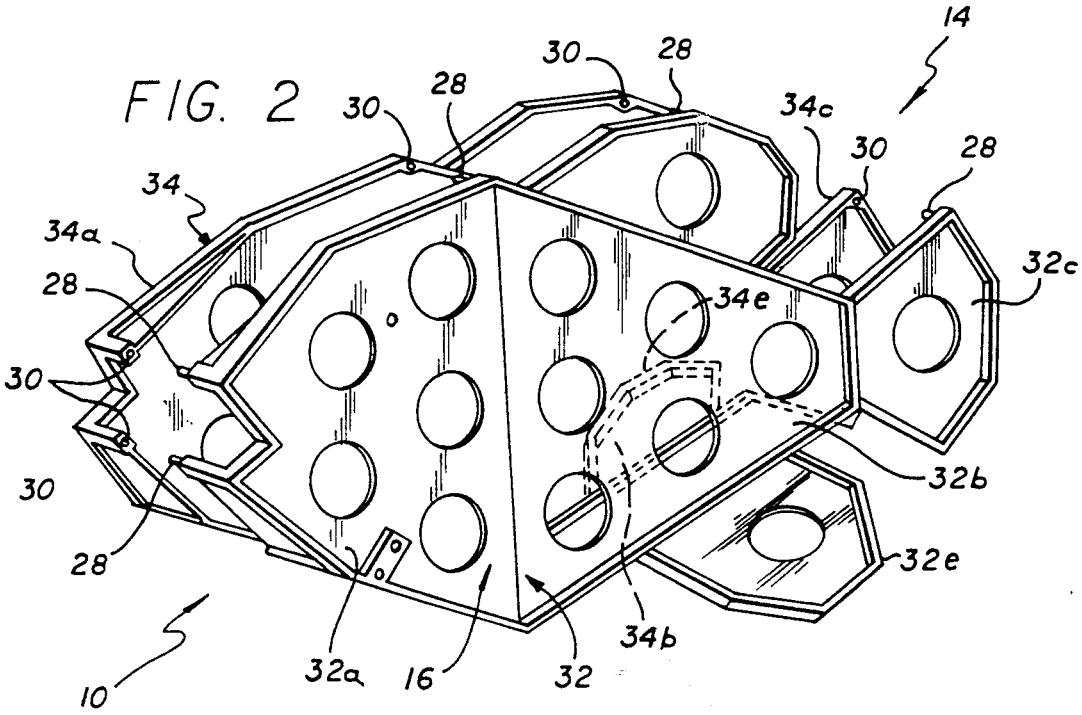
FIG. 2 is a perspective assembly view of the sculpture shown in FIG. 1, illustrating the manner in which congruent smooth-sided primary frame members are joined together by the use of pin and hole interlocks to form a main frame body.

As shown in the drawings for purposes of illustration, the present invention is concerned with a three-dimensional jigsaw puzzle sculpture, generally designated in the accompanying drawings by the reference number 10. In accordance with the present invention, the sculpture 10 comprises, generally, a plurality of jigsaw puzzle pieces 12 which, when assembled, fit into a frame 14 having primary and secondary frame members 16 and 18, respectively.

The puzzle pieces 12 provide the surface design and color of the three-dimensional jigsaw puzzle sculpture 10. As in most jigsaw puzzles, the individual puzzle pieces have side surfaces 20 which interlock with abutting side surfaces of adjacent pieces in a conventional manner. The puzzle pieces have side edges of irregular configuration which interlock with adjacent pieces upon relative movement generally perpendicular to a plane of the other pieces so that when interlocked, the pieces engage so as to prevent separation of one of the pieces in the plane. The puzzle pieces 12 placed outermost in the frame 14 have at least one smooth side which is captured within a channel 22 of the frame. By "smooth", it is meant that the sides of the puzzle pieces 12 and the outer peripheral edges of the frame members 16 and 18 may be curvilinear and/or flat.

The frame 14 is constructed of a rigid material, such as plastic. The primary frame members 16 comprise congruent halves of a main frame body. The secondary frame members 18 are attached to the primary frame members 16 to provide additional detail to the sculpture 10. Each frame member includes one or more substantially planar surfaces 24 for receiving the assembled jigsaw puzzle pieces 12. The assembled puzzle pieces may cover all of the planar surfaces 24 of the frame 14, or they may leave one or more portions of the frame exposed to view. The planar surfaces 24 each include one or more apertures 26 to allow the puzzle pieces 12 to be easily pushed out and removed from the frame (FIG. 5).

The channel 22 extends around the periphery of each frame member 16 and 18 to retain the puzzle pieces 12 in assembled form adjacent to a respective planar surface 24 of the frame 14.

The primary frame members 16 are joined together in several places by a plurality of pin and hole interlocks 28 and 30. A cylindrical pin 28 projects from the one of the primary frame members 16 and is inserted into a corresponding cylindrical hole 30 of the other primary frame member 16, in a friction fit. The pin and hole interlocks 28 and 30 are also used to join the secondary frame members 18 to the primary frame members 16. In this regard, the cylindrical pin 28 projects from the secondary frame member 18 and fits into a corresponding hole 30 in one of the primary frame members 16.

It is to be understood that the assembled puzzle shown in FIG. 1 depicts a fish and is meant to be exemplary only of any one of an unlimited variety of shapes. In the exemplary embodiment, there are two primary frame members 16, a left side 32 and a congruent right side 34, and two secondary frame members 18, a left fin 36 and a right fin 38. There are also two attachments, a left eye 40 and a right eye (not shown). The congruent halves of the primary frame members 16 (the left side 32 and right side 34) are joined together by the pin and hole interlocks 28 and 30.

In the exemplary embodiment, the jigsaw puzzle pieces 12 are assembled into fifteen shapes which fit into the following portions of the frame:

Left front body (32*a*); right front body (34*a*); left rear body (32*b*); right rear body (34*b*); left side of tail (32*c*); right side of tail (34*c*); left upper fin (32*d*); right upper fin (34*d*); left front fin (36); right front fin (38); left rear fin (32*e*); right rear fin (34*e*); front belly (42); middle belly (44); and rear belly (46).

In assembling the three-dimensional jigsaw puzzle sculpture 10, the primary frame members 16 are snapped together utilizing the pin and hole interlocks 28 and 30. The secondary frame members 18 and any attachments are likewise attached to the assembled main frame body. A light weight string 48 may be attached to the frame 14 for hanging the sculpture 10 as shown in FIG. 1. The puzzle pieces 12 are assembled into the various shapes and press fit into the frame 14. When the sculpture 10 is to be disassembled, the frame is snapped apart and the puzzle pieces 12 removed by pushing the underside of the puzzle pieces through the apertures 26.

From the foregoing, it is to be appreciated that the three-dimensional jigsaw puzzle sculpture 10 of the present invention provides a jigsaw puzzle and, at the same time, creates a three-dimensional piece of art that, when finished, may be displayed on a table, bookshelf, or even suspended from a light-weight string. The three-dimensional sculpture can also be disassembled and stored away to provide a puzzle for another time. By providing enough variation in puzzle piece design and/or color, a large variety of possible pictures or designs may be formed.

Although a particular embodiment of the invention has been described in detail for purposes of illustration, various modifications may be made without departing from the spirit and scope of the invention. Accordingly, the invention is not to be limited, except as by the appended claims.

We claim:

1. A three-dimensional jigsaw puzzle sculpture, comprising:

a plurality of jigsaw puzzle pieces having side edges of irregular configuration which interlock with adjacent pieces upon relative movement generally perpendicular to a plane of the other pieces so that when interlocked, the pieces engage so as to prevent separation of one of the pieces in the plane;

a frame having a three-dimensional configuration and a plurality of planar surfaces, the frame including a plurality of removably interlocked endless frame members each having a defined smooth unitary outer periphery defining the boundary of each planar surface, wherein the puzzle pieces are capable of being assembled within and removed from the frame without disassembly of the frame; and means for removably retaining the puzzle pieces in assembly in the frame.

2. A three-dimensional sculpture as set forth in claim 1, wherein the assembled puzzle pieces inside the frame member collectively define a smooth peripheral side surface generally corresponding to the inside of the frame outer periphery.

3. A three-dimensional sculpture as set forth in claim 1, wherein the retaining means comprises a channel defining the frame outer periphery, the channel being configured to capture the smooth peripheral side surfaces of the assembled puzzle pieces.

4. A three-dimensional sculpture as set forth in claim 3, wherein the frame includes congruent primary frame members which when joined to each other at common points, form a main frame body.

5. A three-dimensional sculpture as set forth in claim 4, wherein the frame further includes a secondary frame member attached to the main frame body.

6. A three-dimensional jigsaw puzzle sculpture, comprising:

a plurality of jigsaw puzzle pieces;

a frame having a three-dimensional configuration and a plurality of planar surfaces which underlie and support the puzzle pieces, the frame including a plurality of removably interlocked frame members, wherein each frame member comprises an endless frame for a portion of the jigsaw puzzle pieces, having a defined unitary outer periphery defining the boundary of each planar surface, wherein the jigsaw puzzle pieces are assembled within and removed from the planar surface of each frame member without disassembly of the frame; and means for removably retaining the puzzle pieces in assembly in the frame.

7. A three-dimensional sculpture as set forth in claim 6, wherein the puzzle pieces are assembled into sections corresponding to each frame member, each section of assembled puzzle pieces inside the frame member collectively defining a smooth peripheral side surface generally corresponding to the inside of the respective frame member outer periphery.

8. A three-dimensional sculpture as set forth in claim 7, wherein the retaining means comprises a plurality of channels defining the outer periphery of each frame member, each channel being configured to capture the smooth peripheral side surfaces of the outer puzzle pieces of the corresponding section of assembled puzzle pieces to hold said assembled puzzle pieces adjacent to the underlying substantially planar surface of the frame member.

9. A three-dimensional sculpture as set forth in claim 6, wherein each substantially planar surface defines at least one aperture through which an overlying puzzle piece may be engaged.

10. A three-dimensional sculpture as set forth in claim 6, wherein selected ones of the frame members include a plurality of pins projecting therefrom for insertion into corresponding holes in another frame member, the pins and holes providing a removable interlock for attaching the frame members to one another.

11. A three-dimensional sculpture, comprising:

a plurality of assembled jigsaw puzzle pieces having side edges of irregular configuration which interlock with adjacent pieces upon relative movement generally perpendicular to a plane of the other pieces so that when interlocked, the pieces engage so as to prevent separation of one of the pieces in the plane;

a frame having a three-dimensional configuration and a plurality of planar surfaces which underlie and support a section of assembled puzzle pieces, the frame including a plurality of removably interlocked frame members, wherein each frame member comprises an endless frame for a portion of the jigsaw puzzle pieces, having a defined smooth unitary outer periphery defining the boundary of each planar surface, wherein the puzzle pieces are assembled into and removed from sections corresponding to each frame member without disassembly of the frame, each section of assembled puzzle pieces inside the frame member collectively defining a smooth peripheral side surface generally corresponding to the inside of the respective frame member outer periphery;

a plurality of channels defining the outer periphery of each frame member, each channel being configured to capture the smooth peripheral side surfaces of the outer puzzle pieces of the corresponding section of assembled puzzle pieces to hold said assembled puzzle pieces adjacent to the underlying planar surface of the frame member; and a plurality of pins projecting from at least one of the frame members for insertion into corresponding holes in another frame member, the pins and holes providing a removable interlock for attaching the frame members to one another.

12. A three-dimensional sculpture as set forth in claim 11, wherein said substantially planar surface defines at least one aperture therethrough.

* * * * *